US005423200A

United States Patent [19]

Shore

[11] Patent Number: 5,423,200

[45] Date of Patent: Jun. 13, 1995

[54] ROLLING MILL MATERIAL HANDLING SYSTEM

[75] Inventor: Terence M. Shore, Princeton, Mass.

[73] Assignee: Morgan Construction Company, Worcester, Mass.

[21] Appl. No.: 121,337

[22] Filed: Sep. 14, 1993

[51] Int. Cl.[6] ..... B21B 1/18; B21B 43/00

[52] U.S. Cl. ..... 72/201; 72/203; 72/228; 72/250; 140/2

[58] Field of Search ..... 72/201, 228, 250, 251, 72/426, 203; 83/15, 155.1, 158; 140/1, 2

[56] References Cited

U.S. PATENT DOCUMENTS

| | | | |
|---|---|---|---|
| 1,555,919 | 10/1925 | George et al. | 72/228 |
| 1,962,586 | 6/1934 | Gassen | 72/201 |
| 3,236,084 | 2/1966 | Kato | 72/228 |
| 3,422,654 | 1/1969 | Forsberg | 72/228 |
| 4,388,816 | 6/1983 | Ferkst et al. | 72/201 |
| 4,527,408 | 7/1985 | Jalil | 72/201 |
| 4,982,935 | 1/1991 | Nonini et al. | 72/201 |

FOREIGN PATENT DOCUMENTS

| | | |
|---|---|---|
| 0432531 | 11/1990 | European Pat. Off. . |
| 2129601 | 2/1972 | Germany . |
| 2246740 | 3/1974 | Germany . |
| 2317919 | 10/1974 | Germany . |
| 2517894 | 11/1976 | Germany . |
| 255236 | 3/1988 | Germany . |

*Primary Examiner*—Lowell A. Larson
*Assistant Examiner*—Thomas C. Schoeffler
*Attorney, Agent, or Firm*—Samuels, Gauthier & Stevens

[57] ABSTRACT

A rolling mill material handling system includes a cooling bed and an associated laying head and cooling conveyor. Hot rolled products may be cut into segments which are shifted laterally onto the cooling bed. Alternatively, the hot rolled products may be directed longitudinally in undivided lengths past the cooling bed to the laying head where they are formed into rings and deposited on the cooling conveyor.

14 Claims, 1 Drawing Sheet

ROLLING MILL MATERIAL HANDLING SYSTEM

BACKGROUND OF THE INVENTION

1. Field of the Invention

This invention relates generally to continuous hot rolling mills of the type which produce so called "long products" (e.g., rods, bars and the like), and is concerned in particular with an improved system for handling such products as they emerge from the mill.

2. Description of the Prior Art

In a typical conventional mill installation where for example billets are being rolled continuously into round bars, the finished product is usually subdivided into shorter segments as it emerges from the mill. These product segments are then brought to rest and shifted laterally onto the receiving end of a cooling bed. The product segments undergo cooling as they progress laterally across the cooling bed. Upon arriving at the delivery end of the bed, the cooled product segments are further subdivided into shorter customer lengths prior to being bundled.

Problems often are encountered in the shearing and/or bundling of the product segments leaving the delivery end of cooling bed, causing the cooling bed to become rapidly filled. This in turn necessitates a shut down of the entire mill.

A primary objective of the present invention is to provide an improved material handling system which includes an overflow outlet for the cooling bed in the event that shearing and bundling problems are encountered.

SUMMARY OF THE INVENTION

In a preferred embodiment of the invention, the material handling system includes a shear positioned along the delivery path leading from the mill. The shear is operable selectively in either a first mode in which it subdivides the finished product into segments, or a second mode permitting the product to continue along the delivery path in an undivided state.

A cooling bed is positioned along the delivery path downstream from the shear. A run on table is operable selectively in either a first mode transferring product segments received from the shear onto the cooling bed, or a second mode allowing individual product to continue along the delivery path past the cooling bed.

A laying head is positioned along the delivery path downstream from the cooling bed. The laying head forms undivided product bypassing the cooling bed into rings which are deposited on a cooling conveyor in the form of overlapping non-concentric rings. The rings are cooled on the conveyor before they are gathered into coils at a reforming station at the delivery end of the conveyor.

Preferably, driven pinch roll units are strategically positioned along the rolling line to achieve braking and/or to insure unimpeded progress of the product through the various handling stages. Optionally, a rolling unit can be located between the cooling bed and the laying head to further roll the product into smaller diameter rods and the like.

BRIEF DESCRIPTION OF THE DRAWINGS

These and other objects, features and advantages will be described in greater detail with reference to the accompanying drawings, wherein.

DETAILED DESCRIPTION OF THE INVENTION

Figure 1:
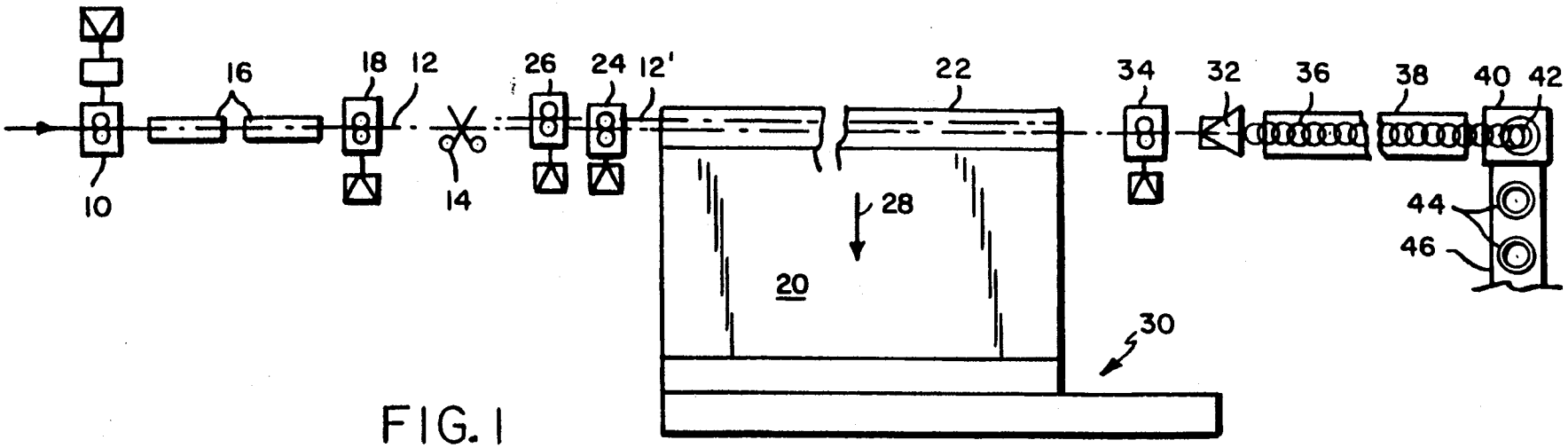
FIG. 1 is a diagrammatic plan view of a material handling system according to one embodiment of the invention.

Referring initially to FIG. 1, the last roll stand of a continuous hot rolling mill is depicted at 10. Hot rolled long products, typically round bars or the like, emerge from roll stand 10 along a delivery path 12. A shear 14 is located along the delivery path 12. The shear may comprise any one of several known conventional designs of the type shown for example in U.S. Pat. Nos. 3,851,556 (Sieurin); 3,834,260 (Sieurin et al). The shear operates to subdivide the finished product emerging from roll stand 10 into shorter segments which proceed alternatively either along delivery path 12 or a parallel path 12'. Typically, one or more water cooling boxes 16 will be arranged between the shear 14 and the roll stand 10 in order to lower the temperature of the product by surface quenching, and a driven pinch roll unit 18 will be provided between the last water box and the shear in order to insure that the product continues to move along the delivery path 12 after the tail end has cleared the last roll stand 10. The pinch roll unit 18 can again be of conventional design, as shown for example in U.S. Pat. No. 4,413,494 (Gilvar et al).

The shear 14 is operable selectively between a first mode subdividing the finished product into segments as described above, and a second mode which permits the finished product to continue along path 12 in an undivided state.

A cooling bed 20 extends laterally from the delivery paths 12, 12' at a location downstream from the shear 14. A run in table 22 is operatively positioned between the delivery paths 12, 12' and the receiving end of the cooling bed. Additional pinch roll units 24, 26 are positioned respectively along paths 12, 12' between the shear 14 and the run in table 22. The pinch roll units 24, 26 operate to decelerate product segments travelling along paths 12, 12', thereby allowing them to slide to a halt within the operative length of the run in table 22.

The run in table may again be of known design, for example as shown in U.S. Pat. No. 4,809,530 (Wilson). The run in table serves to transfer product segments received along paths 12, 12' onto the receiving end of the cooling bed 20 where the segments progress laterally in the direction indicated schematically by arrow 28 to the delivery end of the bed. While moving laterally across the cooling bed, the product segments undergo further cooling in ambient air.

As the product segments arrive at the delivery end of the cooling bed, they are received and further subdivided into customer lengths before being bundled in readiness for storage and subsequent shipment. Equipment employed to received, further subdivide and bundle the product segments is indicated generally at 30. Typical examples of such equipment can be found in U.S. Pat. Nos. 3,718,062 (Gilvar); 4,006,828 (Hill); 3,823,812 (Sieurin); and 3,497,084 (Murrah).

A laying head 32 is positioned along path 12 at a location following the cooling bed 20. Preferably, a pinch roll unit 34 is located between the laying head and the cooling bed in order to insure that product received along path 12 is reliably propelled into and through the laying head.

The laying head operates to form product into a continuous series of rings 36 which are received on a cooling conveyor 38. The conveyor transports the rings in an overlapping non-concentric form to a reforming station 40. A reforming apparatus 42 at station 40 serves to gather the rings into coils 44 which are transported away from station 40 on a conveyor 46. Typical examples of a laying head and cooling conveyor are provided in U.S. Pat. Nos. 4,546,957 (Jalil et al) and 5,121,902 (Jalil et al), and an example of a reforming apparatus is shown in U.S. Pat. No. 4,251,037 (Puchovosky).

When the shear 14 is operating to subdivide finish product into shorter segments, the segments are slowed by the pinch roll units 24, 26 and brought to a stop within the operative range of the run in table 22. The run in table then operates to laterally transfer the segments onto the cooling bed 20 for further processing away from the delivery paths 12, 12'. In this mode of operation, the laying head 32 and its associated material handling components are inoperative.

In the event, however, that difficulties are encountered with the material handling equipment 30, resulting in the cooling bed 20 becoming rapidly filled with product segments, the shear 14 may be adjusted to an alternative mode allowing the finished product to proceed along path 12 in an undivided state. Under these conditions, the run in table 22 is also operatively adjusted to an alternative mode allowing the undivided product to continue past the cooling bed 20 along path 12. The pinch roll unit 34 is then operated to continue propelling the undivided product into and through the laying head 30 where it is formed into rings 36 for deposit on the cooling conveyor 38. As described above, these rings are ultimately gathered into coils at station 40.

It will thus be seen that with the present invention, an overflow capacity is provided for the cooling bed 20. This overflow capacity insures that in the event of a malfunction of the equipment 30, the mill can continue in operation with the finished product being alternatively directed past the cooling bed.

Figure 2:
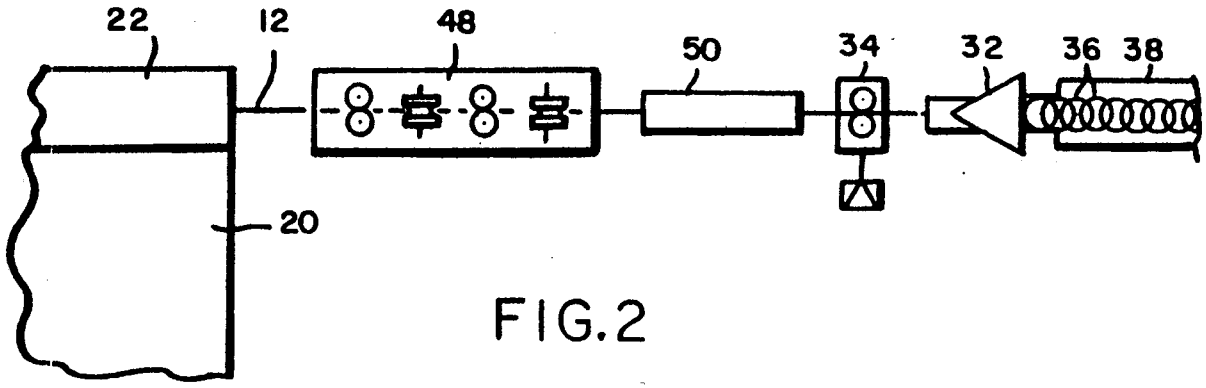
FIG. 2 is a diagrammatic partial plan view showing an alternative embodiment.

An alternative embodiment of the invention is disclosed in FIG. 2. Here, a short rolling block 48 of the type depicted for example in U.S. Pat. No. 4,537,055 (Woodrow et al) is located between the cooling bed 20 and the laying head 32. Preferably, an additional water cooling box 50 is interposed between the delivery end of the block 48 and the pinch roll unit 34 preceding the laying head. With this arrangement, undivided product such as larger diameter bars may be further rolled into smaller products such as rods. This additionally increases the options available to the mill owner.

It will be understood, of course, that in addition to providing overflow capacity, the laying head 32 and cooling conveyor 38 may be operated with or without an associated additional rolling block 48 to handle different types of products irrespective of whether the cooling bed is temporarily filled as a result of a malfunction of the equipment 30.

I claim:

1. A material handling system for hot rolled long product emerging longitudinally along a delivery path from a continuous hot rolling mill, said system comprising:

shear means along said delivery path, said shear means being operable selectively between a first mode subdividing said product into segments and a second mode permitting said product to continue past said shear means and along said path in an undivided state;

a cooling bed positioned alongside said path at a location following said shear means;

transfer means operable selectively between a first mode transferring product segments received from said shear means onto said cooling bed, and a second mode permitting undivided product to continue along said delivery path past said cooling bed;

a laying head positioned along said path at a location following said cooling bed, said laying head being operative to form undivided product into a continuous series of rings;

a conveyor aligned with said delivery path for receiving said rings from said laying head and for transporting said rings to a reforming station; and means at said reforming station for gathering said rings into coils.

2. The material handling system of claim 1 further comprising decelerating means positioned between said shear means and said transfer means for slowing said product segments.

3. The material handling system of claim 2 wherein said decelerating means comprises at least one pinch roll unit.

4. The material handling system of claim 1 further comprising drive means for propelling products into said laying head.

5. The material handling system of claim 4 wherein said means for propelling comprises a pinch roll unit.

6. The material handling system of claim 1 further comprising switch means operating in conjunction with said shear means to direct successive product segments alternatively along said delivery path and an adjacent path parallel thereto.

7. The material handling system of claim 1 wherein said cooling bed has a receiving end underlying said delivery path and a delivery end remotely disposed laterally therefrom, and wherein said transfer means is operable to deposit said product segments onto said receiving end.

8. The material handling system of claim 1 further comprising means associated with said conveyor for cooling the rings being transported to said reforming station.

9. The material handling system of claim 1 further comprising means arranged along said delivery path for cooling said product in advance of said shear means.

10. The material handling system of claim 9 further comprising means interposed between said cooling means and said shear means for propelling said product along said delivery path.

11. The material handling system of claim 10 wherein said propelling means comprises a pinch roll unit.

12. The material handling system of claim 1 further comprising rolling means between said transfer means and said laying head for further reducing a cross sectional area of said product.

13. A method of handling hot rolled long product emerging longitudinally along a delivery path from a continuous hot rolling mill, said method comprising:

passing said product through a shear and selectively operating said shear in either a first mode subdividing the product into segments or in a second mode permitting the product to continue past said shear and along said path in an undivided state;

transferring the product segments laterally from said path onto a cooling bed for continued lateral transfer and cooling thereon;

permitting undivided product to continue along said delivery path past the cooling bed to a laying head which forms the product into a continuous series of rings;

transporting said rings further along said delivery path to a reforming station; and gathering the rings into coils at said reforming station.

14. The method of claim 13 further comprising the step of rolling the undivided product to further reduce its cross sectional area before the product is formed into rings at the laying head.

* * * * *